United States Patent [19]

Mantovani et al.

[11] Patent Number: 5,062,826

[45] Date of Patent: Nov. 5, 1991

[54] DEVICE FOR LOCKING A BLOOD CENTRIFUGATION CELL ON A CHUCK

[76] Inventors: Marco Mantovani, Via Dante Alighieri, 6, 46025 Poggio Rusco (Mantova); Giorgio Rossetto, Via della Liberta, 5, 45037 Melara (Rovigo), both of Italy

[21] Appl. No.: 549,472

[22] Filed: Jul. 6, 1990

[30] Foreign Application Priority Data

Jul. 14, 1989 [IT] Italy ..... 21195 A/89

[51] Int. Cl.[5] ..... B04B 15/00

[52] U.S. Cl. ..... 494/85; 279/1 C; 279/2 R; 366/213; 403/324; 403/328; 494/43

[58] Field of Search ..... 494/84, 85, 43; 366/208, 209, 213, 214; 279/1 C, 2 R; 403/324–328, 378; 269/70, 207, 287

[56] References Cited

U.S. PATENT DOCUMENTS

| | | | |
|---|---|---|---|
| 2,274,681 | 3/1942 | Fletcher | 279/2 R |
| 2,607,601 | 8/1952 | Drewes, Jr. et al. | 279/2 R |
| 2,835,517 | 5/1958 | Beerli | 403/328 |
| 3,581,981 | 6/1971 | Latham, Jr. | 494/84 X |
| 3,706,412 | 12/1972 | Latham, Jr. | 494/84 X |
| 3,785,549 | 1/1974 | Latham, Jr. | 494/85 X |
| 4,718,888 | 1/1988 | Darnell | 494/85 |
| 4,795,419 | 1/1989 | Yawn et al. | 494/84 |
| 4,838,849 | 6/1989 | Calari | 494/85 |

FOREIGN PATENT DOCUMENTS

| | | | |
|---|---|---|---|
| 88/03439 | 5/1988 | World Int. Prop. O. | 494/84 |

*Primary Examiner*—Philip R. Coe
*Assistant Examiner*—C. Cooley
*Attorney, Agent, or Firm*—P. C. Richardson; L. C. Akers; R. C. Turner

[57] ABSTRACT

The invention provides a device for locking the base of a blood centrifugation cell on a rotatable generally disc shaped chuck plate. The chuck plate encloses a plurality of elastic locators which extend radially a slight distance from the periphery of the plate. The plate further encloses a plurality of locking means which are biased to remain within the dimensions of the plate at rest and which are radially extendable by centrifugal force to extend beyond the periphery of the plate. An annular locking ring engages the base of the cell and extends around the periphery of the chuck plate. The locking ring has a plurality of internal recesses for initially receiving the elastic locators, and the locking means during centrifugation to secure the cell to the chuck plate.

11 Claims, 3 Drawing Sheets

DEVICE FOR LOCKING A BLOOD CENTRIFUGATION CELL ON A CHUCK

BACKGROUND OF THE INVENTION

The invention relates to a device for locking a blood centrifugation cell on a rotatable chuck.

The centrifugation of blood results in the separation of various weight fraction components such as plasma, red cells, platelets and white cells within centrifugation cells. The centrifugation cells include a stationary coupling to which ducts are connected for the inflow of the blood and for the outflow of the separated fraction to be extracted. In order to rotate the centrifugation cell, the base of the cell is locked on a chuck connected to a rotatable shaft. The locking mechanisms of the prior art do not always adequately secure the cell to the chuck and usually require special tools which can be difficult and time consuming to actuate. Typical prior art locking mechanisms include various jaws and ring segments which retain several points of the base of the cell to the chuck, but such locking elements are difficult to put in place an do not ensure absolute safety in the locking of the cell.

SUMMARY OF THE INVENTION

An object of the present invention is to provide a device for safely and securely locking a blood centrifugation cell on a chuck easily and quickly by an operator without requiring the use of any tool.

The invention provides a device for locking the base of a blood centrifugation cell on a rotatable generally disc shaped chuck plate. The chuck plate encloses a plurality of elastic locators which extend radially a slight distance from the periphery of the plate. The plate further encloses a plurality of locking means which are biased to remain within the dimensions of the plate at rest and which are radially extendable by centrifugal force to extend beyond the periphery of the plate. An annular locking ring engages the base of the cell and extends around the periphery of the chuck plate. The locking ring has a plurality of internal recesses for initially receiving the elastic locators, and the locking means during centrifugation to secure the cell to the chuck plate.

BRIEF DESCRIPTION OF THE DRAWINGS

Further characteristics and advantages will become apparent from the description of preferred but not exclusive embodiments of the invention, illustrated only by way of non-limitative example in the accompanying drawings, wherein.

DETAILED DESCRIPTION OF THE INVENTION

With reference to the above figures, a chuck plate 1 on which a blood centrifugation cell 2 is shown secured by an annular locking ring 3 of the present invention. The locking ring 3 includes an annular inward flange 3*a* which is adapted to engage a corresponding annular outward flange at the base of the cell, and which includes a cylindrical portion which is adapted to extend beyond the periphery of the chuck plate 1. The cell and locking ring are initially positioned to the chuck plate by means of elastic locators, and are rigidly secured during rotation by locking elements within the plate which engage the ring by centrifugal force.

Figure 1:
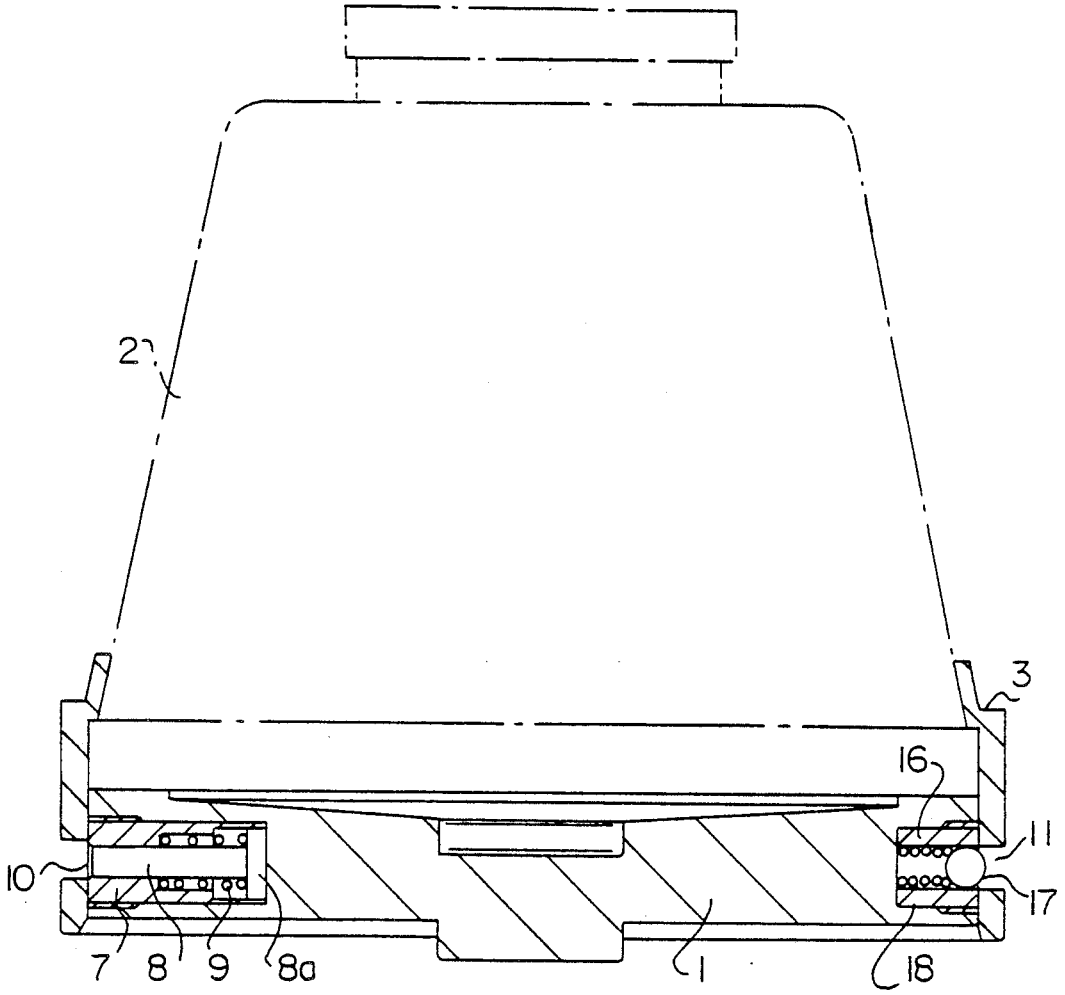
FIG. 1 is a sectional view of the invention, taken along the plane I—I of FIG. 2, with the cell indicated in broken lines, and with assembled locking and elastic locator elements.
Figure 2:
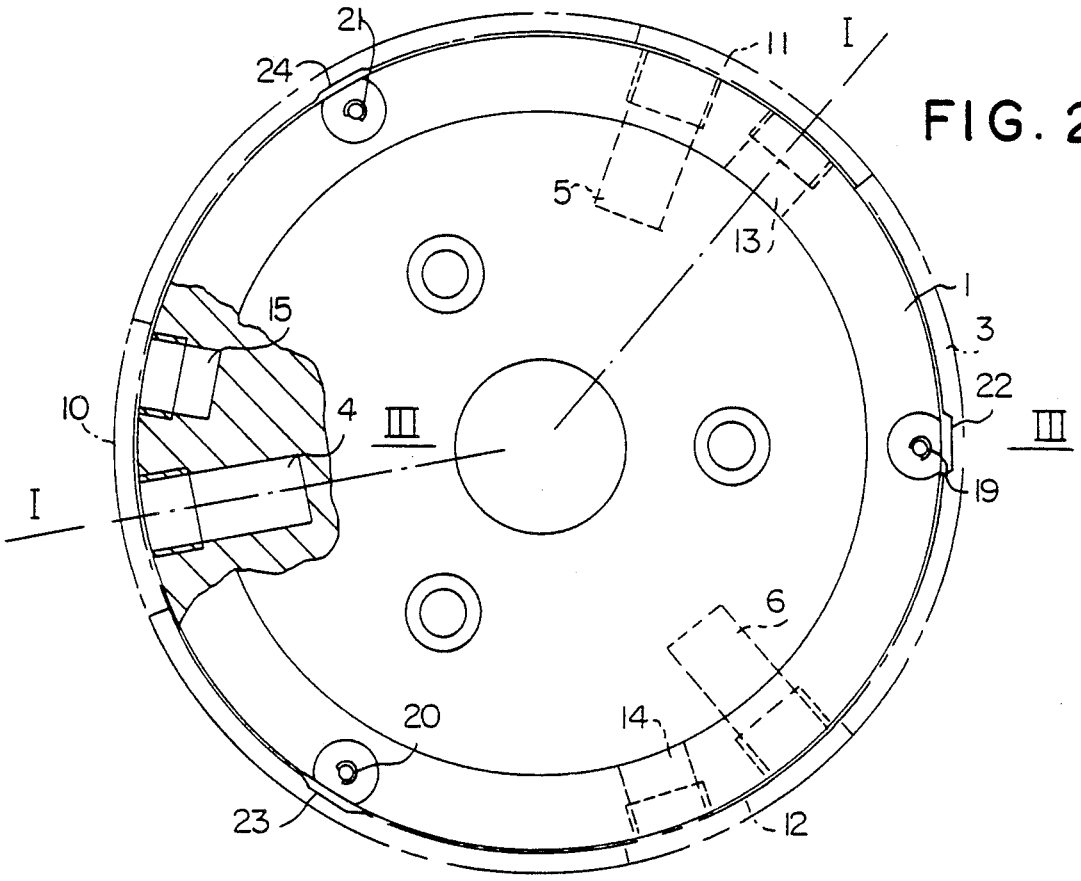
FIG. 2 is a plan view of the chuck plate.
Figure 6:
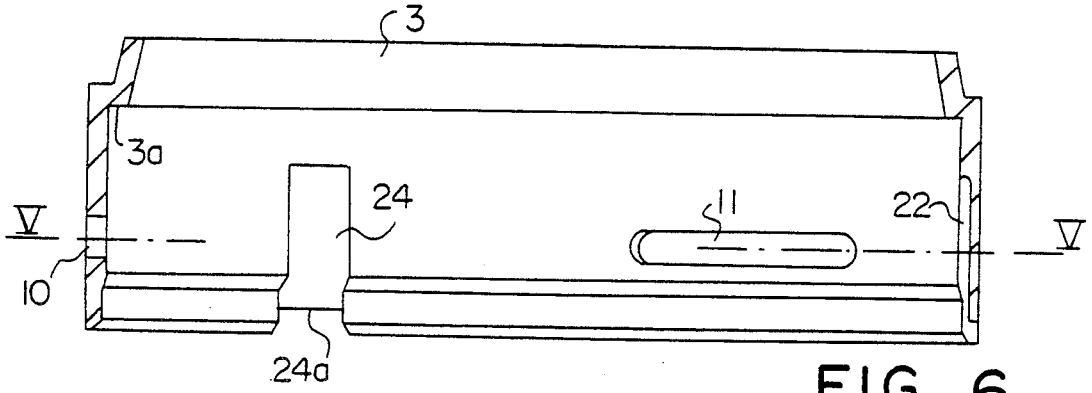
FIG. 6 is a sectional side view of the locking ring, taken along the plane VI—VI of FIG. 5.
Figure 5:
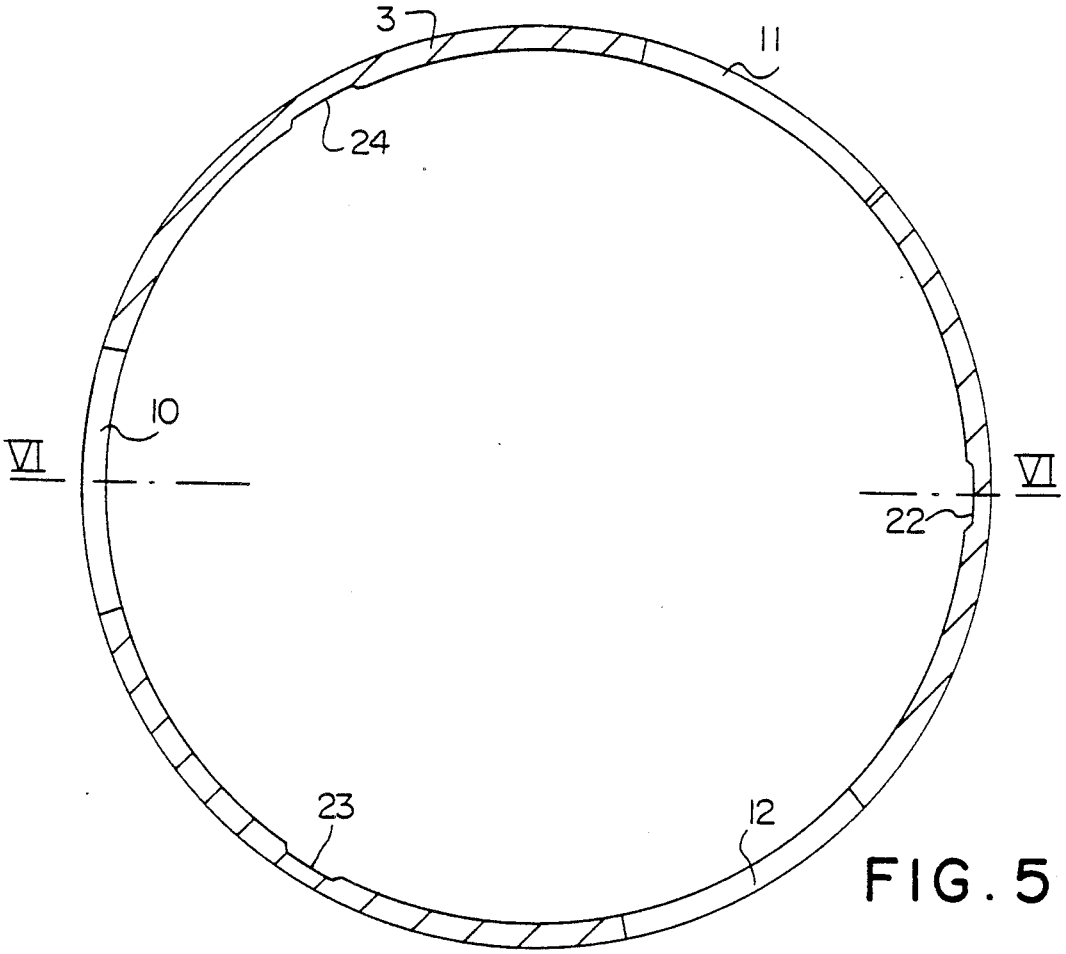
FIG. 5 is a sectional plan view of the locking ring, taken along the plane V—V of FIG. 6.

The locking elements are particularly illustrated in FIGS. 1 and 2. The chuck plate 1 includes three radial bore holes 4, 5 and 6, which are each threaded to receive a generally cylindrical sleeve 7 which encloses a slidable pin 8 having a base 8*a*. The sleeve is counterbored to retained a compression spring 9 between the sleeve and the pin base 8*a*, so that the pin is normally biased radially inwardly within the chuck plate. The locking ring 3 has three openings shown as slots 10, 11 and 12 aligned with the heads of the pins 8. The openings could similarly be precise circular apertures or internal recesses within the ring but are preferably slots.

When the chuck plate 1 is at rest, the springs 9 retain the pins 8 within the plate (as shown in FIG. 1). When the plate is rotated, centrifugal force is generated on the pins 8 and overcomes the bias action of the springs, pushing the pins radially outward so that each pin engages the corresponding slot 10, 11 and 12 of the locking ring to securely lock the cell 2 to the chuck plate. Upon completion of the centrifugal rotation, the angular velocity of the chuck plate decreases and the spring 9 is then adequate to retract the pins radially inwardly within the chuck plate.

As previously discussed, the blood centrifugation cell 2 and the locking ring 3 are initially positioned on the chuck plate 1 by elastic locators shown in FIGS. 1 and 2. The elastic locators are positioned contiguous with the locking elements in bore holes 13, 14 and 15 in the chuck plate 1. An example of an elastic locator is a small cylinder 16 which retains a spherical ball 17 which is biased outwardly by a compression spring 18. The cylinders 16 are retained in the plate by suitable thread engagement into corresponding threads in the bore holes 13, 14 and 15, so that the ball extends a slight distance from the periphery of the chuck plate.

When the locking ring 3 is slid over the periphery of the chuck plate, the lower end of the ring (aided by an internal annular bevel) compresses the balls 17 against the springs 18 within the plate. When the slots 10, 11 and 12 of the ring are adjacent to the elastic locators, the springs force the balls 17 into the slots with a "perceptible snap" to properly align and initially secure the cell and ring onto the chuck plate. The elastic locators could engage discrete apertures or recesses in the locking ring, however since the elastic locators and the locking elements are contiguous, the use of the common slots 10, 11 and 12 are convenient and assure that the ring is properly aligned to receive the locking elements during centrifugation.

As shown particularly in FIGS. 3–6 the plate 1 and locking ring 3 are also provided with upper and lower rigid locators to radially orient the ring relative to the plate to insure the engagement of the elastic locators and the locking elements into the respective slots.

The upper rigid locators comprise three screws 26 inserted in threaded holes 19, 20 and 21 provided on the upper face of the chuck plate 1. The holes are arranged in such a position as to allow the heads of the screws to protrude from the periphery of the plate by an amount suitable to slidably engage longitudinal grooves 22, 23 and 24 provided in the ring. The lower rigid locators comprise three tabs 27 which are fixed by means or screws in holes such as 25 and which protrude from the periphery of the plate by an amount adapted to engage a notch (24*a* shown in FIG. 6) provided at the base of each of the grooves 22, 23, 24. The tabs 27 and the respective notch provide a clear visual reference for the operator while positioning the locking ring on the plate.

Figure 7:
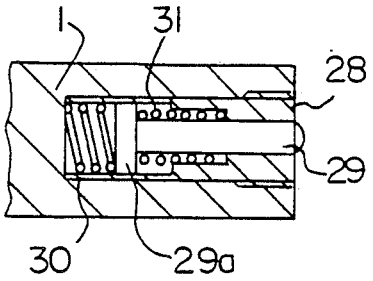
FIG. 7 is a partial sectional view similar to FIG. 1 illustrating a further embodiment of a combined locking and elastic locator element.
Figure 4:
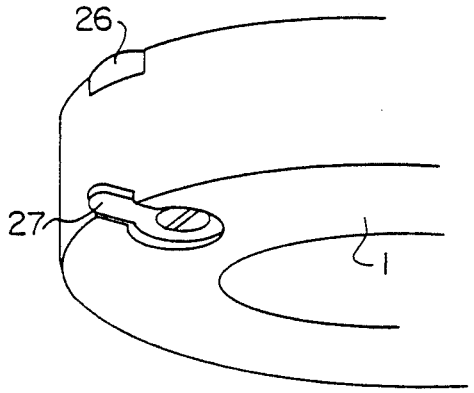
FIG. 4 is a partial lower side perspective view of a detail of the chuck plate illustrating one of the rigid locators.
Figure 3:
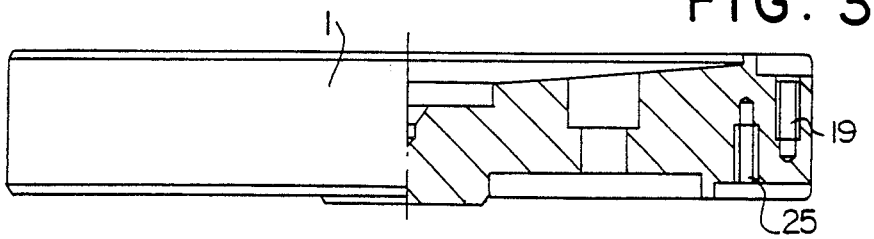
FIG. 3 is a partially sectional side view of the chuck plate, taken along the plane III—III of FIG. 2.

FIG. 7 illustrates a further embodiment of the locking element and of the elastic locator, which instead of being constituted by separate elements as in the first described embodiment are combined into a single device. A cylindrical sleeve 28 is associated with a radial hole of the plate 1 and slidably contains a pin 29 which has a slightly extended rounded head and is provided with a foot 29*a* on which compression springs 30 and 31 act on opposite sides. The springs are dimensioned so that their balanced action allows the pin 29 to perform as the elastic locator to initially position the cell and ring, and to further extend outwardly during centrifugation to perform as the locking element within the corresponding opening in the locking ring.

From what has been described, the invention thus allows the cell to be positioned and locked on the chuck in an extremely rapid and easy manner, without the aid of any tool. The operator simply places the cell on the chuck plate, then positions the locking ring over the cell and plate following the indications provided by the fixed locators until the elastic locators snap into the slots, and then the action of the centrifugal force automatically provides the locking of the cell to the plate.

The described invention is susceptible to numerous modifications and variations, all of which are within the scope of the inventive concept; thus, for example, the ring may be associated with the cell in any manner, by gluing, welding, mechanical coupling or by being monolithic with the cell itself.

The locking and locator elements can furthermore be provided in a different manner and can be arranged with respect to one another differently from the described manner, so long as they are always evenly distributed along the circumference of the plate for obvious reasons of dynamic balancing.

What is claimed is:

1. A device for locking the base of a blood centrifugation cell on a rotatable disc-shaped chuck plate characterized in that it comprises:

a plurality of locking means enclosed within the chuck plate which are based radially into the chuck plate to remain within the dimensions of the chuck plate when at rest and which are radially expandable out of the chuck plate by centrifugal force to extend radially beyond the periphery of the chuck plate during rotation;

an annular locking ring for engaging the base of the cell and for extending around the periphery of said chuck plate;

said locking ring having a plurality of recesses for receiving said locking means during rotation.

2. The device according to claim 1, characterized in that the cell includes an annular flange extending from the base thereof; and said ring is removably associated with the cell and is provided with an annular inward flange for axially engaging the flange of said cell.

3. The device according to claim 1, characterized in that said ring is formed as part of the cell.

4. The device according to claim 1, characterized in that it comprises a plurality of compressible elastic locators enclosed within the chuck plate which are radially biased to extend a slight radial distance from the periphery of the plate; and said locking ring recesses receiving said elastic locators.

5. The device according to claim 4, characterized in that said plate includes a plurality of first bore holes and a plurality of second bore holes, wherein one first bore hole and a second bore holes form a contiguous pair;

said locking means comprises a cylindrical sleeve within each of said first bore holes; a pin having a base thereon and which is slidably retained between each said base and said sleeve so that said pins engage said recesses in said locking ring during rotation;

and characterized in that said elastic locators comprise a spherical ball and a compression spring retained within each of said second bore holes so that said balls are compressible within said plate by said locking ring and which are extendable to engage said recesses in said ring to initially retain the cell and the ring when at rest.

6. The device according to claim 5, characterized in that said plate includes three first bore holes and three contiguous second bore holes, and said recesses in said locking ring are arranged as three lateral slots.

7. The device according to claim 4 wherein said plate further includes at least one fixed radial locator which extends a slight distance from the periphery of said plate, and said ring includes at least one longitudinal grooved recess for slidably receiving and retaining said radial locator so that said first and second recesses are respectively aligned for engagement with said locking means and said elastic locators.

8. The device according to claim 1 wherein said plate includes a plurality of first radial bore holes in the periphery thereof and said locking means comprises:

a cylindrical sleeve enclosed within each of said bore holes;

a pin having a base thereon and which is slidably retained within each of said sleeves;

a spring retained between each said base and said sleeve.

9. The device according to claim 8, characterized in that said plate further includes a plurality of second radial holes each contiguous to one of the first bore holes and said elastic locators comprise a spherical ball and a compression spring retained within each of said second bore holes so that said balls are compressible within said plate by said locking ring and which are extendable to engage said recesses in said ring.

10. A device according to claim 1, characterized in that said locking means is further elastically based so that when at rest said locking means is extended a slight radial distance from the periphery of said plate so that said locking means is compressible within said plate by said locking ring for thereafter extending into said recess to initially secure said cell and said ring onto said plate; and is further extendable and non-compressible during rotation.

11. The device according to claim 10, characterized in that said plate includes a plurality of radial bore holes in the periphery thereof and said locking means comprises:

a cylindrical sleeve enclosed within each of said bore holes;

a pin having a head and a foot and which is slidably retained within each of said sleeves;

a first spring positioned between each said sleeve and the base of said bore hole to elastically extend said pin a slight radial distance beyond the periphery of said plate, and a second spring positioned between each said foot and said sleeve to retract said pin to a desired position when the plate is not rotating.

* * * * *